US005765955A

United States Patent [19]

Tani

[11] Patent Number: 5,765,955

[45] Date of Patent: Jun. 16, 1998

[54] STICK-SHAPED COSMETIC CARTRIDGE AND STICK-SHAPED COSMETIC EXTRUSION CASE

[75] Inventor: Yoshikazu Tani, Tokyo, Japan

[73] Assignee: Tokiwa Corporation, Gifu, Japan

[21] Appl. No.: 690,182

[22] Filed: Jul. 25, 1996

[51] Int. Cl.[6] ..... A45D 40/00

[52] U.S. Cl. ..... 401/68

[58] Field of Search ..... 401/49, 55, 56, 401/57, 62, 68

[56] References Cited

U.S. PATENT DOCUMENTS

| | | | |
|---|---|---|---|
| 2,168,877 | 8/1939 | Noyack et al. | 401/68 |
| 2,789,692 | 4/1957 | Ferri | 401/68 |
| 3,132,743 | 5/1964 | Wolff | 401/68 |
| 5,009,534 | 4/1991 | Gueret | 401/68 X |
| 5,230,577 | 7/1993 | Cox et al. | 401/68 |
| 5,423,623 | 6/1995 | Bakic | 401/68 X |
| 5,547,302 | 8/1996 | Dornbusch et al. | 401/68 X |

FOREIGN PATENT DOCUMENTS

| | | | |
|---|---|---|---|
| 4340067 | 5/1994 | Germany | 401/68 |
| 6181813 | 7/1994 | Japan | 401/68 |
| 9208387 | 5/1992 | WIPO | 401/68 |

*Primary Examiner*—William E. Stoll

*Attorney, Agent, or Firm*—Greer, Burns, Crain, Ltd.

[57] ABSTRACT

The present invention provides a stick-shaped cosmetic extrusion case in which a stick-shaped cosmetic cartridge is removably attached to a case body so that a stick-shaped cosmetic can be replaced by replacing the cartridge with another one. The stick-shaped cosmetic accommodated in the cartridge is extruded through the case body by rotating the cartridge attached to the case body relative to the case body. The cartridge includes a housing cylinder, a holder, and a spring. The holder holds the stick-shaped cosmetic, and is accommodated in a through hole formed in the housing cylinder. The holder is biased by the spring to retain the stick-shaped cosmetic within the through hole. The holder has a holding portion for holding the base of the stick-shaped cosmetic and a shaft portion projecting downwardly from the bottom of the holding portion. The holding portion is inserted into a large-diameter hole portion of the housing cylinder, is axially movable, and engages a stepped portion of the housing cylinder when located at the lowermost position, thereby restricting its downward movement. The shaft portion is designed to enter into a small-diameter hole portion of the housing cylinder when the holding portion engages the stepped portion of the housing cylinder. The spring biases the holding portion of the holder toward the stepped portion of the housing cylinder with one end thereof engaging the shaft portion of the holder and the other end engaging the small-diameter hole portion of the housing cylinder.

14 Claims, 15 Drawing Sheets

STICK-SHAPED COSMETIC CARTRIDGE AND STICK-SHAPED COSMETIC EXTRUSION CASE

BACKGROUND OF THE INVENTION

1. Field of the Invention

The present invention relates to a case, more particularly to a case accommodating a stick-shaped cosmetic, such as a lipstick, allowing the cosmetic to be extruded little by little.

2. Description of the Related Art

A stick-shaped cosmetic such as a lipliner, a lipstick, a concealer, an eyeliner, or the like is usually enclosed in a case, is extruded from the case for use, and is drawn to be enclosed again in the case after use.

Various structures of stick-shaped cosmetic extrusion cases suitable for use in such a manner have been proposed. For example, Japanese Patent Publication No. HO3-71121 discloses a stick-shaped cosmetic extrusion case comprising an external cylinder, an internal cylinder rotatably fitted in the external cylinder with the tip of the internal cylinder protruding from the external cylinder, and a holder for holding a stick-shaped cosmetic which is disposed inside the internal cylinder to be allowed to move axially but not allowed to rotate circumferentially, and a converter, incorporated in the external cylinder, the internal cylinder, and the holder for converting the relative rotation between the external cylinder and the internal cylinder into the axial movement of the holder. In the stick-shaped cosmetic extrusion case, by relatively rotating the external cylinder and the internal cylinder, the holder is moved in the axial direction in the internal cylinder, thereby extruding and drawing the stick-shaped cosmetic from/into the internal cylinder. The stick-shaped cosmetic extrusion case of this type does not allow the stick-shaped cosmetic to be replaced with another one. Therefore, when the stick-shaped cosmetic is consumed, the stick-shaped cosmetic extrusion case should be disposed of.

Japanese Utility Model Publication No. HO3-31232 discloses a stick-shaped cosmetic extrusion case of such a type to allow the stick-shaped cosmetic to be replaced with another one.

The extrusion case has a stick-shaped cosmetic cartridge (hereinafter, referred to as "cartridge") which is removably fitted in an external cylinder, and an extrusion rod enclosed in the external cylinder, wherein the rotation of the cartridge fitted in the external cylinder relative to the external cylinder moves the extrusion rod in the axial direction in the external cylinder. The cartridge has a housing cylinder which is provided with a through hole penetrating in the axial direction, the cross section of which is substantially constant and into which a holder holding the stick-shaped cosmetic is fitted movably in the axial direction. The through hole has a portion, the diameter of which is slightly large (hereinafter, referred to as a "large-diameter portion"), at the lower end of the housing cylinder. The housing cylinder is provided with a spring for biasing the holder downwardly ( in such a direction as to make the holder close to the case body), an end of which is engaged with the large-diameter portion. To prevent the holder and the spring from coming off the housing cylinder, a cap for preventing the falling is attached to the large-diameter portion of the housing cylinder.

Therefore, the components of the cartridge are assembled not to fall apart even individually handling the cartridge. For example when the stick-shaped cosmetic in the stick-shaped cosmetic extrusion case is consumed or when a stick-shaped cosmetic of another color is desired to use, the cartridge fitted in the external cylinder can be replaced with another cartridge.

It should be noted that, in the stick-shaped cosmetic extrusion case, the extrusion rod moves upwardly by rotating the external cylinder relative to the cartridge in the clockwise direction, with the result that the extrusion rod presses the holder upwardly against the biasing force of the spring to extrude the stick-shaped cosmetic from the housing cylinder. On the other hand, the extrusion rod moves downwardly by rotating the external cylinder relative to the cartridge in the anti-clockwise direction, with the result that the holder moves downward following the extrusion rod because of the biasing force of the spring to draw the stick-shaped cosmetic into the housing cylinder.

However, the cap must be attached to the housing cylinder for preventing the holder and the spring from coming off the housing cylinder. This increases the number of the components of the stick-shaped cosmetic extrusion case.

In the cartridge, the stick-shaped cosmetic is fixed to the holder by rigidly fixing the base of the stick-shaped cosmetic to the holder. Therefore, when the stick-shaped cosmetic extrusion case is exerted with external impact, the impact is directly transmitted to the stick-shaped cosmetic so that the cosmetic might be damaged.

SUMMARY OF THE INVENTION

It is an object of the present invention to reduce the number of components of an stick-shaped cosmetic cartridge and the number of components of a stick-shaped cosmetic extrusion case.

It is another object of the present invention to block impact transmission to a stick-shaped cosmetic held by the holder as possible.

It is another object of the present invention to provide a stick-shaped cosmetic cartridge allowing easy handling.

1. A first aspect of the present invention is a stick-shaped cosmetic cartridge comprising a housing cylinder, a holder, and a spring.

The housing cylinder is formed in a hollow cylindrical configuration with a through hole penetrating in the axial direction. The housing cylinder comprises a stepped portion formed on the way of the through hole, a large-diameter hole portion from the stepped portion to the distal end (upper side) thereof, and a small-diameter hole portion from the stepped portion to the base end (lower side) thereof.

The holder has a holding portion for holding the base of a stick-shaped cosmetic and a shaft portion projecting outward (downward) from a bottom portion of the holding portion. The holding portion is inserted into the large-diameter hole portion of the housing cylinder in such a manner that the holding portion is movable in the axial direction and engages the stepped portion of the housing cylinder in the lowermost position so as to restrict its downward movable range. The shaft portion is formed in such a manner as to enter in the small-diameter hole portion of the housing cylinder when the holding portion engages the stepped portion of the housing cylinder.

The spring is disposed with one end thereof engaging the shaft portion of the holder and the other end thereof engaging the small-diameter hole portion of the housing cylinder so as to bias the holding portion of the holder in such a direction as to make the holding portion close to the stepped portion of housing cylinder.

The cartridge mentioned above does not need a cap for preventing the falling at the base end (lower end) of the housing cylinder, thereby reducing the number of components of the cartridge and facilitating the handling of the cartridge.

In the stick-like cosmetic cartridge of the invention, the following construction can be applied.

(1) the holding portion of the holder comprises a bottom plate and a pair of holding pieces standing on the bottom plate to face each other, and the holding pieces hold the base of the stick-shaped cosmetic therebetween by applying elasticity thereof. As the stick-shaped cosmetic is elastically held in this way, external impact exerted to the holder and the stick-shaped cosmetic can be absorbed, thereby preventing damage of the stick-shaped cosmetic.

(2) The small-diameter hole portion of the housing cylinder is provided with a stepped portion to have a larger diameter at the base end side of the housing cylinder, the shaft portion of the holder is provided with a stopping projection formed on an outer surface thereof, and the one end of the spring engages the stopping projection of the holder and the other end engages the stepped portion of the small-diameter hole portion of the housing cylinder.

2. A second aspect of the present invention is a stick-shaped cosmetic extrusion case comprising a case body, a housing cylinder, a holder, a spring, an extrusion rod, and a transformation mechanism.

The case body is formed in a hollow cylindrical configuration with at least one open end.

The housing cylinder is formed in a hollow cylindrical configuration with a through hole penetrating in the axial direction. The housing cylinder comprises a stepped portion formed on the way of the through hole, a large-diameter hole portion from the stepped portion to the distal end (upper side) thereof, and a small-diameter hole portion from the stepped portion to the base end (lower side) thereof. A base portion (lower portion) of the housing is inserted into the case body and a distal portion (upper portion) thereof projects outward (upward) through the open end of the case body in such a manner that the housing cylinder is permitted to rotate relative to the case body and not permitted to move in the axial direction.

The holder has a holding portion for holding the base of a stick-shaped cosmetic and a shaft portion projecting outward (downward) from a bottom portion of the holding portion. The holding portion is inserted into the large-diameter hole portion of the housing cylinder in such a manner that the holding portion is movable in the axial direction and engages the stepped portion of the housing cylinder in the lowermost position so as to restrict its downward movable range. The shaft portion is formed in such a manner as to enter in the small-diameter hole portion of the housing cylinder when the holding portion is in a position where engaging the stepped portion of the housing cylinder.

The spring is disposed with one end thereof engaging the shaft portion of the holder and the other end thereof engaging the small-diameter hole portion of the housing cylinder so as to bias the holding portion of the holder in such a direction as to make the holding portion close to the stepped portion of housing cylinder.

The extrusion rod is accommodated in the case body, a distal portion of the extrusion rod is inserted into the small-diameter hole portion of the housing cylinder through an opening at the base side (lower side) of the housing cylinder in such a manner that the extrusion rod is movable in the axial direction relative to the case body and the housing cylinder. The extrusion rod extrudes the shaft portion of the holder against the biasing force of the spring when the extrusion rod moves toward the large-diameter hole portion of the housing cylinder.

The transformation mechanism is disposed for transforming the relative rotation between the case body and the housing cylinder into the axial movement of the extrusion rod relative to the housing cylinder. The transformation mechanism may be any mechanism as far as it has the aforementioned function.

In the stick-shaped cosmetic extrusion case, by relatively rotating the case body and the housing cylinder, the extrusion rod moves in the axial direction. The extrusion rod pushes the holder upward against the biasing force of the spring when the extrusion rod moves in a direction (upward) toward the housing cylinder, thereby extruding the stick-shaped cosmetic from the housing cylinder. Conversely, when the extrusion rod moves in such a direction (downward) as to be apart from the housing cylinder, the holder also moves downward following the extrusion rod since the holder is biased downward by the spring, thereby drawing the stick-shaped cosmetic inside the housing cylinder.

The cartridge mentioned above does not need a cap for preventing the falling at the base end (lower end) of the housing cylinder which was conventionally necessary, thereby reducing the number of components of the cartridge and facilitating the handling of the cartridge.

In the stick-like cosmetic cartridge of the invention, the following construction can be applied.

(1) The cross section of the large-diameter hole portion of the housing cylinder, the cross section of the holding portion of the holder, and the cross section of the stick-shaped cosmetic are formed in non-circular configurations which are similar to each other. This prevents the holder and the stick-shaped cosmetic from rotating relative to the housing cylinder. The term "non-circular" means any configuration but true circle, such as an oval, a triangle, and a rectangle.

(2) Fixed to the base of the housing cylinder is a short cylinder having a through hole through which the extrusion rod is inserted, and the transformation mechanism comprises a helical groove formed inside the case body, an engaging protrusion formed in the extrusion rod which engages the groove of the case body and slides along the groove, protrusions formed on an outer surface of the extrusion rod and elongated in the axial direction, and protrusions formed in an inner surface of the through hole of the short cylinder which engages the protrusion of the extrusion rod to prevent the relative rotation between the short cylinder and the extrusion rod and to permit the relative linear movement between the short cylinder and the extrusion rod.

(3) The housing cylinder, the holder, the spring, and the short cylinder mentioned above (2) are previously assembled together in the housing cylinder to constitute a stick-shaped cosmetic cartridge, the stick-shaped cosmetic cartridge is attachable and removable to/from the case body in which the extrusion rod is previously installed.

(4) Disposed between the case body and the short cylinder mentioned above (2) is a frictional ring made of elastic material in a ring-like configuration through which the extrusion rod is inserted. The frictional ring causes a suitable frictional resistance during the case body and the housing cylinder rotate relative to each other, thereby preventing the undesirable rotation between the case body and the housing cylinder and facilitating the control in the length of the extruded stick-shaped cosmetic for use.

(5) The frictional ring mentioned above is disposed between the case body and the short cylinder in the elastically compressed state, thereby preventing the rotation of the stick-shaped cosmetic during the user is putting the cosmetic on her lip or the like.

3. A third aspect of the present invention is a stick-shaped cosmetic extrusion case comprising a case body, a rotating cylinder, a housing cylinder, a holder, a spring, an extrusion rod, and a transformation mechanism.

The case body is formed in a hollow cylindrical configuration with at least one open end.

The rotating cylinder is formed in a hollow cylindrical configuration with at least one open end. The rotating cylinder is installed into the case body with the open end thereof being disposed in the same direction as the open end of the case body in such a manner that the rotating cylinder is permitted to rotate relative to the case body and not permitted to move in the axial direction.

The housing cylinder is formed in a hollow cylindrical configuration with a through hole penetrating in the axial direction. The housing cylinder comprises a stepped portion formed on the way of the through hole, a large-diameter hole portion from the stepped portion to the distal end (upper side) thereof, and a small-diameter hole portion from the stepped portion to the base end (lower side) thereof. A base portion (lower portion) of the housing is inserted into the rotating cylinder and a distal portion (upper portion) thereof projects outward (upward) through the open end of the rotating cylinder in such a manner that the housing cylinder is permitted to rotate relative to the rotating cylinder and not permitted to move in the axial direction.

The holder has a holding portion for holding the base of a stick-shaped cosmetic and a shaft portion projecting outward (downward) from a bottom portion of the holding portion. The holding portion is inserted into the large-diameter hole portion of the housing cylinder in such a manner that the holding portion is movable in the axial direction and engages the stepped portion of the housing cylinder in the lowermost position so as to restrict its downward movable range. The shaft portion is formed in such a manner as to enter in the small-diameter hole portion of the housing cylinder when the holding portion is in a position where engaging the stepped portion of the housing cylinder.

The spring is disposed with one end thereof engaging the shaft portion of the holder and the other end thereof engaging the small-diameter hole portion of the housing cylinder so as to bias the holding portion of the holder in such a direction as to make the holding portion close to the stepped portion of housing cylinder.

The extrusion rod is accommodated in the rotating cylinder, a distal portion of the extrusion rod is inserted into the small-diameter hole portion of the housing cylinder through an opening at the base side (lower side) of the housing cylinder in such a manner that the extrusion rod is movable in the axial direction relative to the rotating cylinder and the housing cylinder. The extrusion rod extrudes the shaft portion of the holder against the biasing force of the spring when the extrusion rod moves toward the large-diameter hole portion of the housing cylinder.

The transformation mechanism is disposed for transforming the relative rotation between the case body and the housing cylinder into the axial movement of the extrusion rod relative to the housing cylinder. The transformation mechanism may be any mechanism as far as it has the aforementioned function.

In the stick-shaped cosmetic extrusion case, by relatively rotating the case body and the housing cylinder, the case body and the rotating cylinder rotate relative to each other so that the extrusion rod moves in the axial direction. The extrusion rod pushes the holder upward against the biasing force of the spring when the extrusion rod moves in a direction (upward) toward the housing cylinder, thereby extruding the stick-shaped cosmetic from the housing cylinder. Conversely, when the extrusion rod moves in such a direction (downward) as to be apart from the housing cylinder, the holder also moves downward following the extrusion rod since the holder is biased downward by the spring, thereby drawing the stick-shaped cosmetic inside the housing cylinder.

The cartridge mentioned above does not need a cap for preventing the falling at the base end (lower end) of the housing cylinder which was conventionally necessary, thereby reducing the number of components of the cartridge and facilitating the handling of the cartridge.

In the stick-like cosmetic cartridge of the invention, the following construction can be applied.

(1) The cross section of the large-diameter hole portion of the housing cylinder, the cross section of the holding portion of the holder, and the cross section of the stick-shaped cosmetic are formed in non-circular configurations which are similar to each other. This prevents the holder and the stick-shaped cosmetic from rotating relative to the housing cylinder. The term "non-circular" means any configuration but true circle, such as an oval, a triangle, and a rectangle.

(2) the transformation mechanism comprises a helical groove formed inside the case body, a guide slot formed in the rotating cylinder and elongated in the axial direction, and an engaging protrusion radially protruding outward from an outer surface of the extrusion rod and penetrating through the guide slot of the rotating cylinder so that a distal end thereof engages the groove of the case body and slides along the groove.

(3) the holder and the spring are previously assembled in the housing cylinder to constitute a stick-shaped cosmetic cartridge, the stick-shaped cosmetic cartridge is attachable and removable to/from the case body in which the rotating cylinder and the extrusion rod are previously installed.

(4) Disposed between the case body and the rotating cylinder is a frictional ring made of elastic material. The frictional ring causes a suitable frictional resistance during the case body and the rotating cylinder rotate relative to each other, thereby preventing the undesirable rotation between the case body and the housing cylinder and facilitating the control in the length of the extruded stick-shaped cosmetic for use.

It should be noted that, in the stick-shaped cosmetic cartridge according to any one of the first, second, and third inventions, the stick-shaped cosmetic may be a lipliner, a lipstick, a concealer, an eyeliner, or the like.

DETAILED DESCRIPTION OF THE PREFERRED EMBODIMENT

Hereinafter, preferred embodiments of the present invention will be described with reference to attached drawings.

[First Embodiment]

A first embodiment of a stick-shaped cosmetic cartridge and a stick-shaped cosmetic extrusion case with the cartridge according to the present invention will be described with reference to FIG. 1 through FIG. 14.

Figure 1:
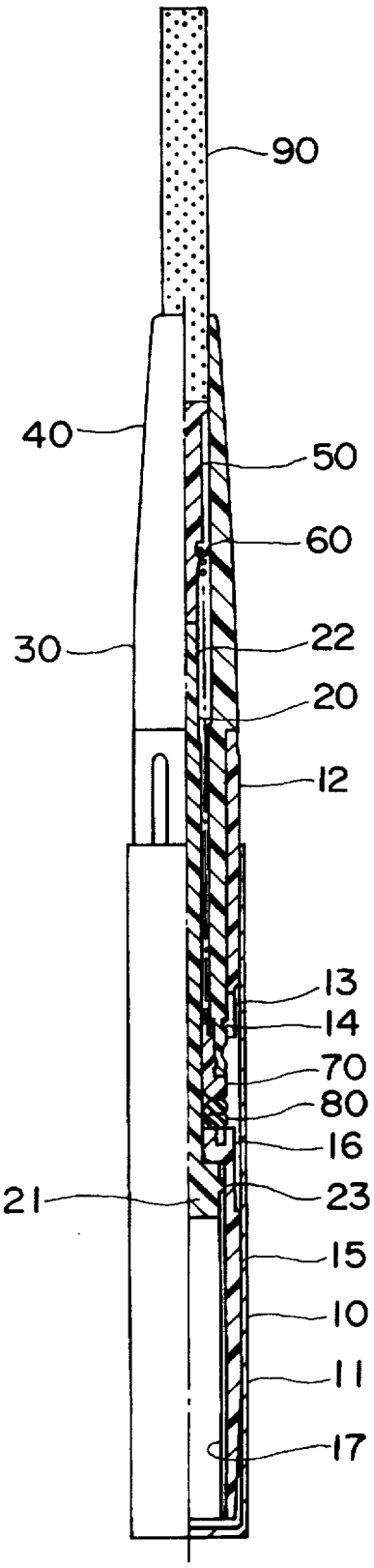
FIG. 1 is a front view showing a stick-shaped cosmetic extrusion case according to a first embodiment of the present invention in the extruded state, the right half being broken away in a section.
Figure 2:
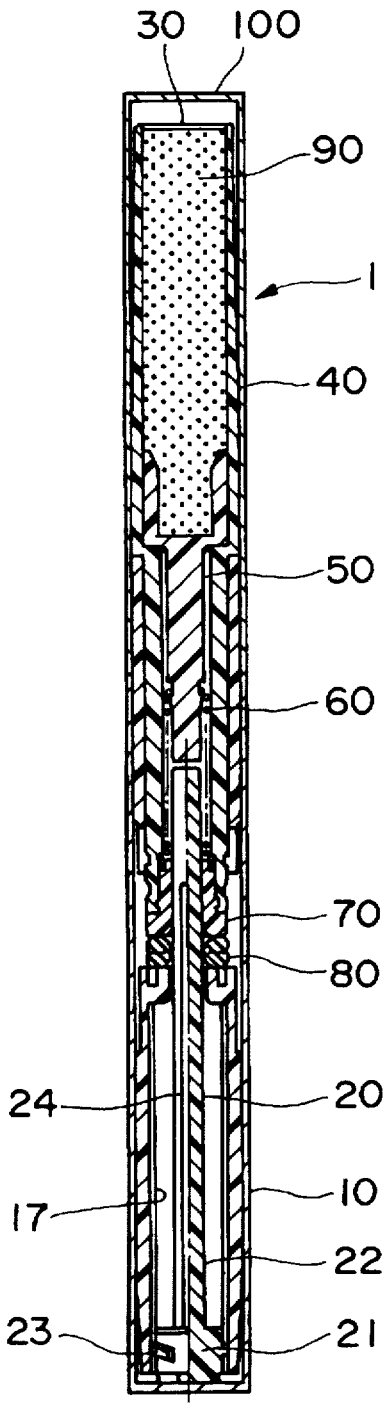
FIG. 2 is a longitudinal sectional view of the stick-shaped cosmetic extrusion case of the first embodiment.

As shown in FIG. 1 and FIG. 2, a stick-shaped cosmetic case (hereinafter, referred to "the case") 1 comprises a case body 10, an extrusion rod 20 fixed inside the case body 10 in such a manner that the extrusion rod is movable in the axial direction, a stick-shaped cosmetic cartridge (hereinafter, referred to "the cartridge") 30 removably attached to the case body 10, and a cap 100 permitted to be attached and removed to/from the case body 10.

The case body 10 comprises an external cylinder 11 made of metal in an open cylindrical shape with a bottom, a supporting cylinder 12 made of resin fixed to an upper open end of the external cylinder 11, and an internal cylinder 15 made of resin fixed to the inner lower part of the external cylinder 11.

The supporting cylinder 12 is a hollow cylinder with both open ends and is inserted into the external cylinder 11 and fixed to the external cylinder 11 with an upper portion thereof protruding from the upper edge of the external cylinder 11. The supporting cylinder 12 is provided with a plurality of slits formed in the lower portion thereof circumferentially at predetermined intervals, which linearly extend upward from the bottom end. The slits divide the lower portion of the supporting cylinder 12 into a plurality of elastic strips 13. Each elastic strip 13 is provided with a projection 14 projecting radially from an inner surface of the lower end thereof.

The internal cylinder 15 is a hollow cylinder with both open ends and comprises a narrowed portion 16 formed on the upper end portion thereof and internal threads (helical grooves) 17 formed in the inner surface below the narrowed portion 16.

The extrusion rod 20 is attached inside the internal cylinder 15. The extrusion rod 20 is made of resin and comprises a large-diameter portion 21 at the lower end thereof and a stem 22 extending upward from the large-diameter portion 21. The large-diameter portion 21 is provided with external threads (engaging protrusions) 23 formed in the outer surface thereof, which engage the internal threads 17 of the internal cylinder 15. The tip of the stem 22 project upward through the narrowed portion 16 of the internal cylinder 15. The stem 22 is provided with a plurality of axially-elongated protrusions 24 formed on the outer surface thereof at predetermined intervals circumferentially.

Figure 3:
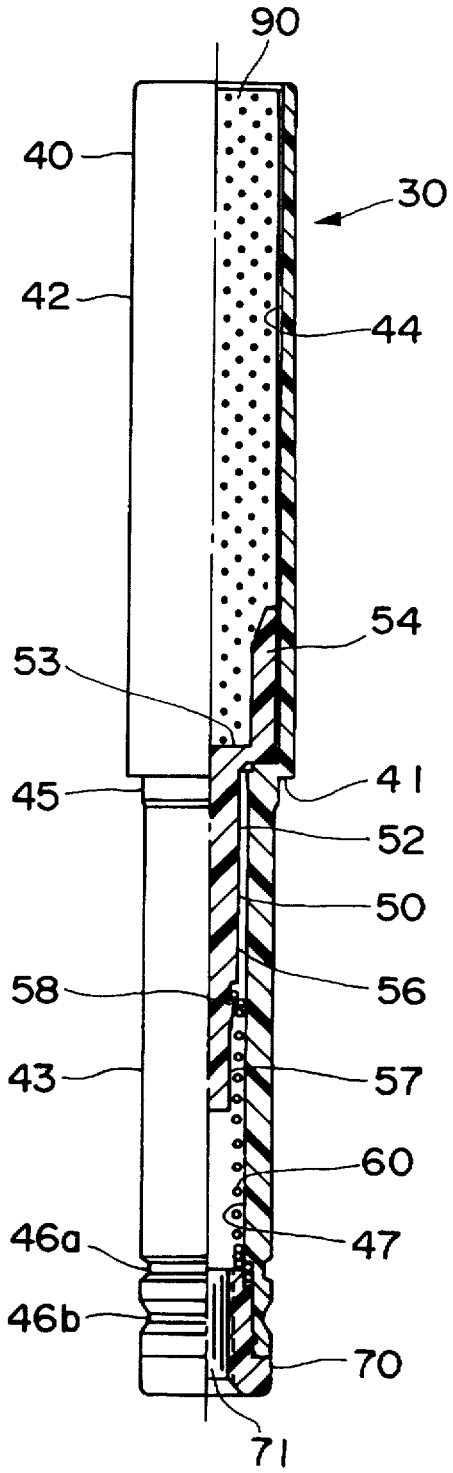
FIG. 3 is a front view showing a stick-shaped cosmetic cartridge according to the first embodiment of the present invention, the right half being broken away in a section.

The cartridge 30 is removably attached to the supporting cylinder 12 of the case body 10. FIG. 3 is a front view of the cartridge 30 with the right half being broken away in a longitudinal section. The cartridge 30 comprises a housing cylinder 40, a holder 50 inserted into the housing cylinder 40 to be permitted to move in the axial direction, a spring 60 disposed between the housing cylinder 40 and the holder 50, and a bottom cap 70 fixed to the lower end of the housing cylinder 40.

The housing cylinder 40 is a hollow cylinder made of resin with both open ends. The housing cylinder 40 is provided with a stepped portion 41 at substantially the middle thereof in the longitudinal direction to make an upper portion having larger diameter than that of a lower portion thereof. The upper portion than the stepped portion 41 is a non-circular portion 42 and the lower portion than the stepped portion 41 is a circular portion 43.

Figure 5:
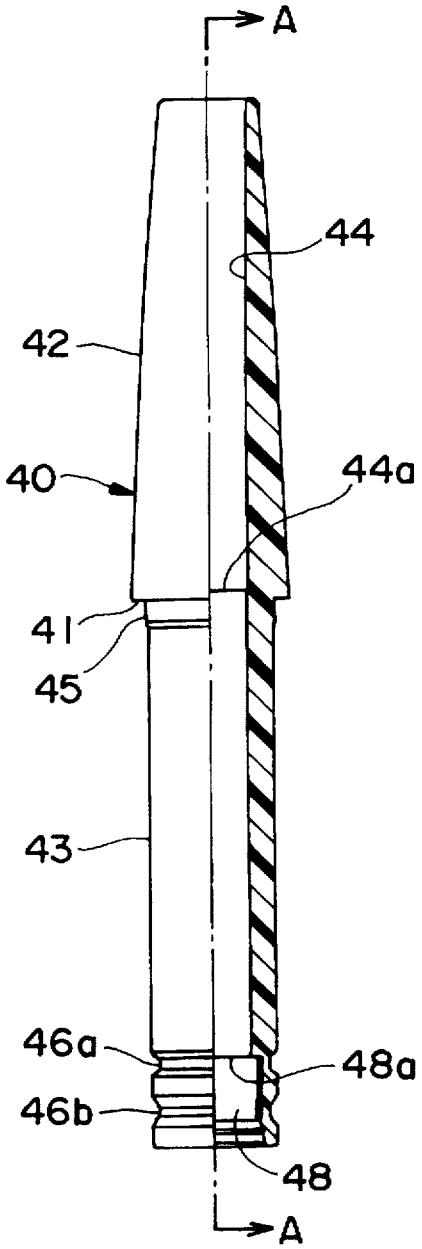
FIG. 5 is a front view showing a housing cylinder of the stick-shaped cosmetic cartridge according to the first embodiment, the right half being broken away in a section.
Figure 6:
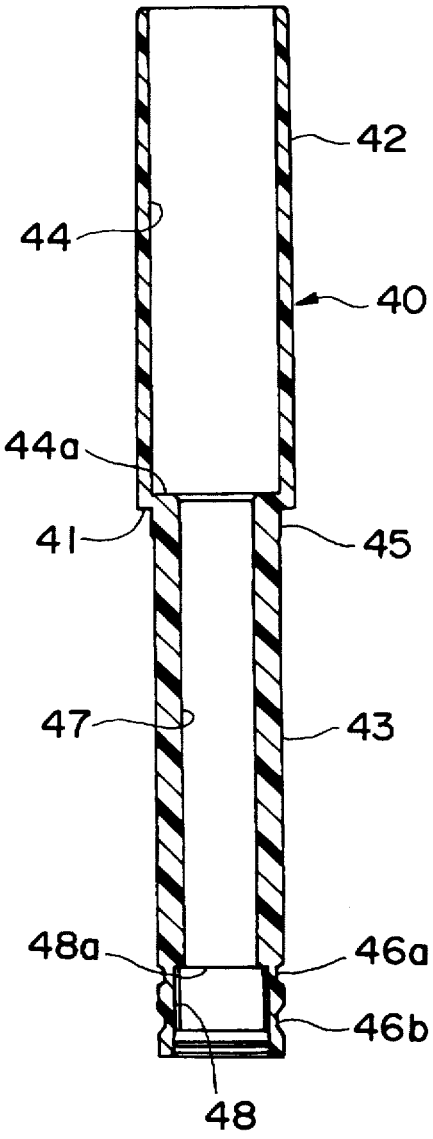
FIG. 6 is a sectional view taken along the line A—A in FIG. 5.
Figure 7:
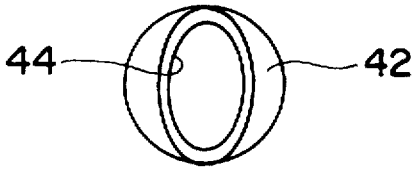
FIG. 7 is a plan view of the housing cylinder of the stick-shaped cosmetic cartridge according to the first embodiment.

The non-circular portion 42 is formed in such a manner that near the stepped portion 41, it has a substantially circular cross section, and the upper and farther away from the stepped portion 41, it has a flatter oval cross section, as shown in FIG. 5 through FIG. 7. The non-circular portion 42 has a large-diameter hole portion 44 having an oval cross section, penetrating the non-circular portion 42 in the axial direction. The cross section and dimensions of the large-diameter hole portion 44 are constant over the entire length of the large-diameter hole portion 44.

The circular portion 43 is formed in such a manner as to have a circular cross section of substantially the same outer diameter over the entire length thereof. The circular portion 43 has a sliding portion 45 near the stepped portion 41 which has a slightly larger diameter than the other portion. The circular portion 43 is provided with ring-like grooves **46*a*, 46*b*** spaced apart from each other in the vertical direction and each formed in the outer surface of the lower end portion thereof.

When the circular portion 43 of the housing cylinder 40 is inserted into the supporting cylinder 12 of the case body 10, the stepped portion 41 comes in contact with the upper end of the supporting cylinder 12, the sliding portion 45 rotatably engages the supporting cylinder 12, and the projections 14 of the elastic strips 13 of the supporting cylinder 12 engage the upper groove **46*a*, thereby preventing the axial movement of the cartridge 30. In this way, the cartridge 30 is attached to the supporting cylinder 12. Therefore, the cartridge 30 is attached to the case body 10 in such a manner to be permitted to rotate but not permitted to move in the axial direction relative to the case body 10**.

The circular portion 43 has a small-diameter hole portion 47 having a circular cross section, which is formed inside thereof along the axial direction. The small-diameter hole portion 47 is disposed coaxially with the large-diameter hole portion 44 of the non-circular portion 42 and communicates with the large-diameter hole portion 44. A stepped portion **44*a* is formed on the boundaries between the large-diameter hole portion 44 and the small-diameter hole portion 47**.

The circular portion 43 is provided with a hole 48, of which diameter is slightly larger than that of the small-diameter hole portion 47, inside the lower end thereof and a stopping stepped portion **48*a* formed between the small-diameter hole portion 47 and the hole 48**.

Figure 8:
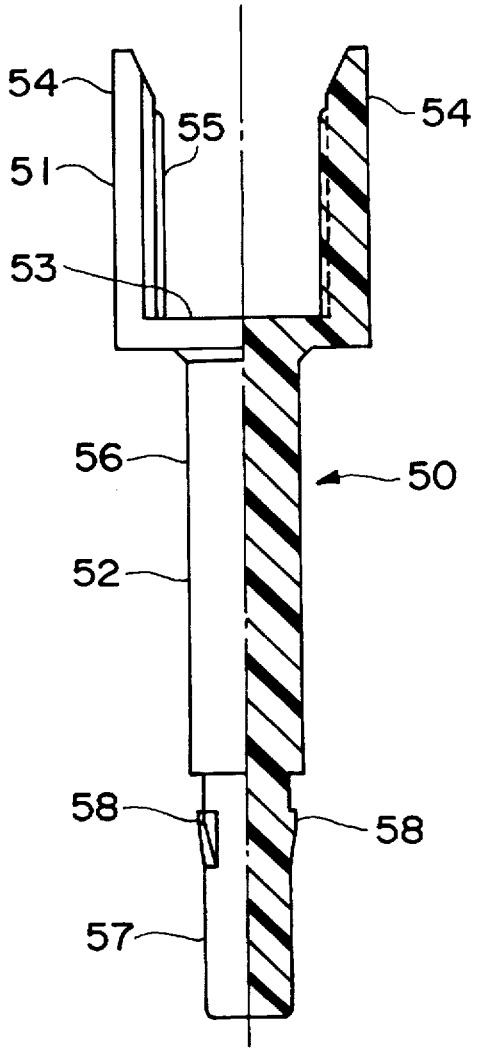
FIG. 8 is a front view showing a holder of the stick-shaped cosmetic cartridge according to the first embodiment, the right half being broken away in a section.
Figure 9:
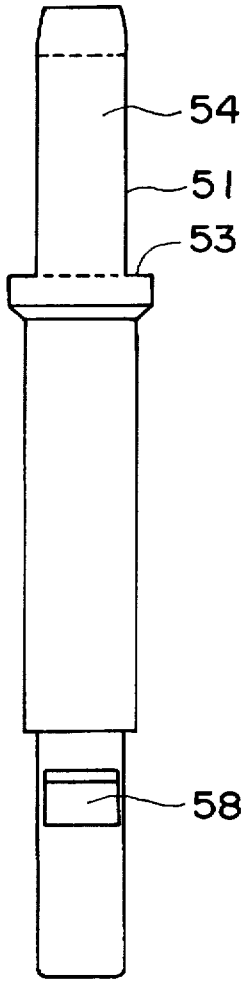
FIG. 9 is a right-side view of the holder of the stick-shaped cosmetic cartridge according to the first embodiment.
Figure 10:
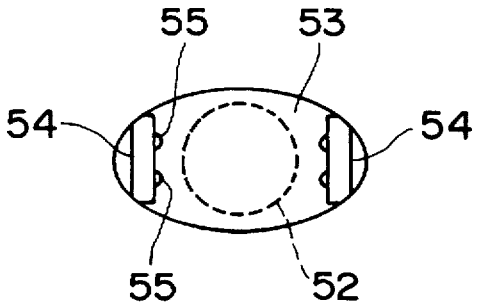
FIG. 10 is a plan view of the holder of the stick-shaped cosmetic cartridge according to the first embodiment.

The holder 50 inserted into the housing cylinder 40 is made of resin and comprises a holding portion 51 and a shaft portion 52, as shown in FIG. 8 and FIG. 9. As shown in FIG. 10, the holding portion 51 has a bottom plate 53 formed in oval in its top view, and a pair of plate-like holding pieces 54 standing on the bottom plate 53 at the both sides in the longitudinal direction to face each other. The bottom plate 53 is formed in a configuration similar to the cross section of the large-diameter hole portion 44 but of which diameter is smaller than that of the large-diameter hole portion 44 so that the holder can move in the axial direction inside the large-diameter hole portion 44. The holding pieces 54 is each provided with two projections 55 extending in the axial direction formed on the opposite face thereof.

The shaft portion 52 has a circular cross section and comprises a large-diameter shaft portion 56 at the upper side and a small-diameter shaft portion 57 at the lower side thereof. The small-diameter shaft portion 57 is provided with stopping projections 58, spaced apart from each other circumferentially at a degree of 180*, on the outer surface thereof.

Figure 11:
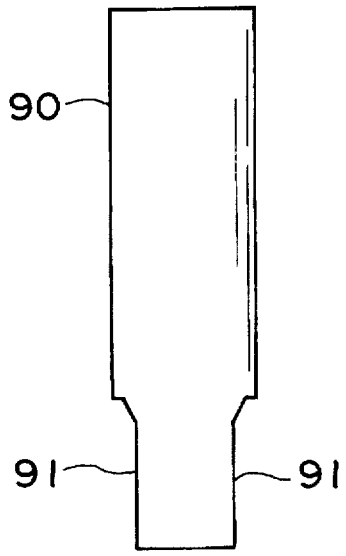
FIG. 11 is a front view of the stick-shaped cosmetic in the stick-shaped cosmetic cartridge according to the first embodiment.
Figure 12:
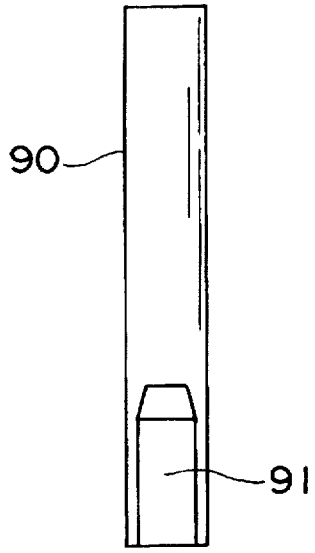
FIG. 12 is a right-side view of the stick-shaped cosmetic in the stick-shaped cosmetic cartridge according to the first embodiment.
Figure 13:
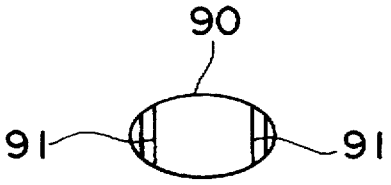
FIG. 13 is a plan view of the stick-shaped cosmetic in the stick-shaped cosmetic cartridge according to the first embodiment.

The holder 50 holds a stick-shaped cosmetic 90 attached therein. As shown in FIG. 11 through FIG. 13, the stick-shaped cosmetic 90 has the same oval cross section as that of the bottom plate 53 of the holder 50 in size and configuration and comprises engaging concavities 91, 91 formed in the lower end portion thereof on the both sides in the longitudinal direction of the oval section. The engaging concavities 91, 91 are allowed to engage the holding pieces 54, 54 of the holder 50.

That is, the holding pieces 54, 54 hold the bottom of the stick-shaped cosmetic 90 therebetween through the engaging concavities 91, 91 so that the holder 50 elastically holds the stick-shaped cosmetic 90. As the stick-shaped cosmetic 90 is elastically held in such a manner, external impact exerted to the holder 50 and the stick-shaped cosmetic 90 can be absorbed, thereby preventing damage of the stick-shaped cosmetic 90.

Figure 4:
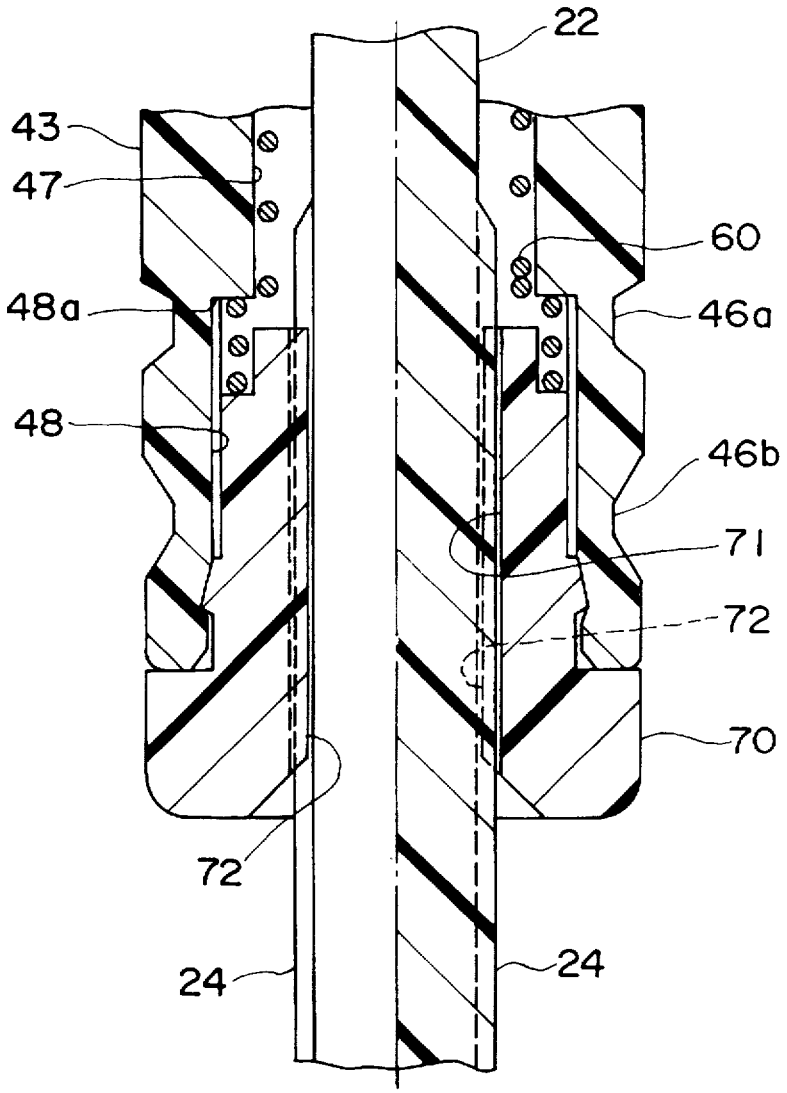
FIG. 4 is an enlarged longitudinal sectional view showing components of the stick-shaped cosmetic cartridge and an extrusion rod of the first embodiment.

The holder 50 is biased by the spring 60 beneath the housing cylinder 40. The spring 60 is fitted, with an upper end (one end) thereof engaging the stopping projection 58 of the holder 50 and a lower end (the other end) engaging the stopping stepped portion **48*a* of the housing cylinder 40 as shown in FIG. 4, so as to bias the holder 50 beneath the housing cylinder 40 whereby the bottom plate 53 of the holder 50 is normally seated in the stepped portion 44*a* of the housing cylinder 40 as shown in FIG. 2. At this point, the shaft portion 52 of the holder 50 is accommodated in the small-diameter hole portion 47 of the housing cylinder 40** entirely.

In the cartridge 30 as structured above, even individually handling the cartridge 30 out of the case body 10, the holder 50 never comes off the housing cylinder 40. This operation does not relate to the presence or absence of a bottom cap 70.

The bottom cap (short cylinder) 70 made of resin is attached to the lower end of the housing cylinder 40. The bottom cap 70 is provided with a through hole 71 extending in the axial direction, through which the stem 22 of the extrusion rod 20 can be inserted.

As shown in FIG. 4, the through hole 71 is provided with a plurality of protrusions 72 which extend in the axial direction and are circumferentially disposed at predetermined intervals. The protrusions 72 engage the protrusions 24 disposed on the extrusion rod 20 so as to prevent the relative rotation between the bottom cap 70 and the extrusion stem 20.

Where the cartridge 30 is installed in the case body 10, the bottom cap 70 is pierced with the upper portion of the stem 22 of the extrusion rod 20 which is thus inserted into the small-diameter hole portion 47 of the housing cylinder 40. The stem 22 and the shaft portion 52 of the holder 50 are sized in such a manner as to have a slight space between the upper end of the stem 22 and the lower end of the shaft portion 52.

Figure 14:
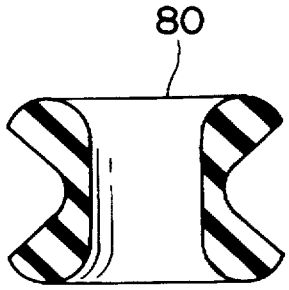
FIG. 14 is a vertical sectional view of a frictional ring of the stick-shaped cosmetic extrusion case according to the first embodiment.
Figure 15:
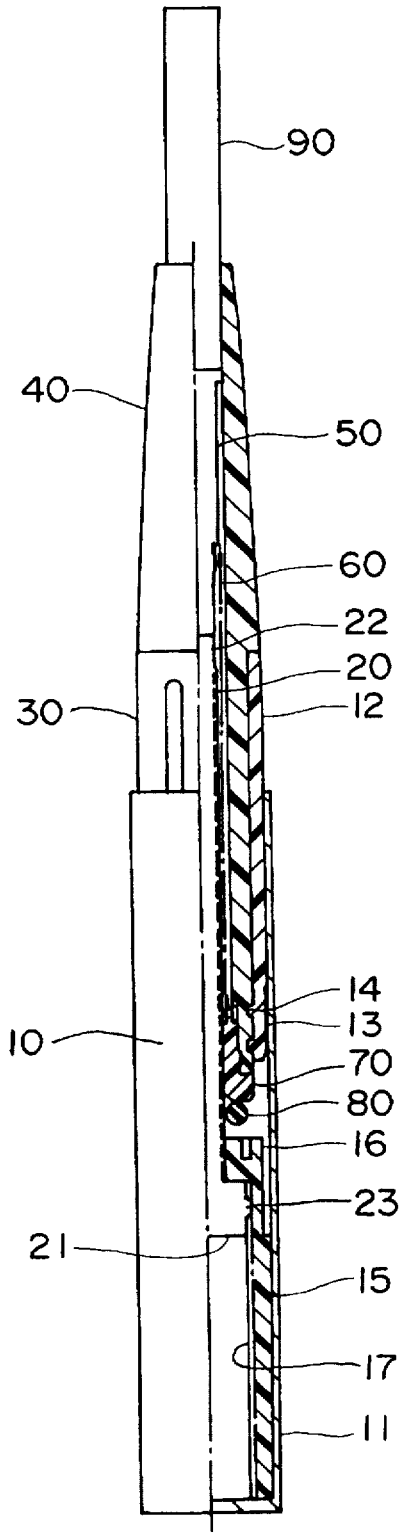
FIG. 15 is a front view showing a stick-shaped cosmetic extrusion case according to a second embodiment of the present invention in the extruded state, the right half being broken away in a section.
Figure 17:
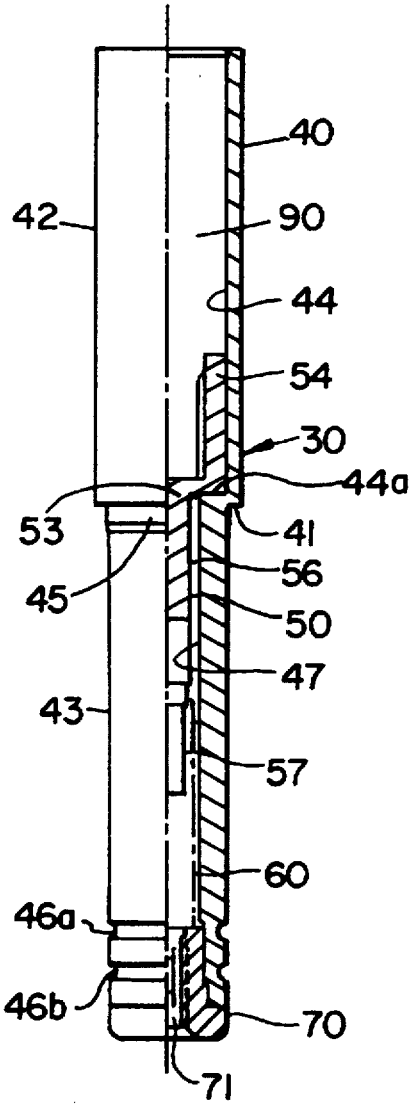
FIG. 17 is a front view showing a stick-shaped cosmetic cartridge according to the second embodiment of the present invention, the right half being broken away in a section.
Figure 16:
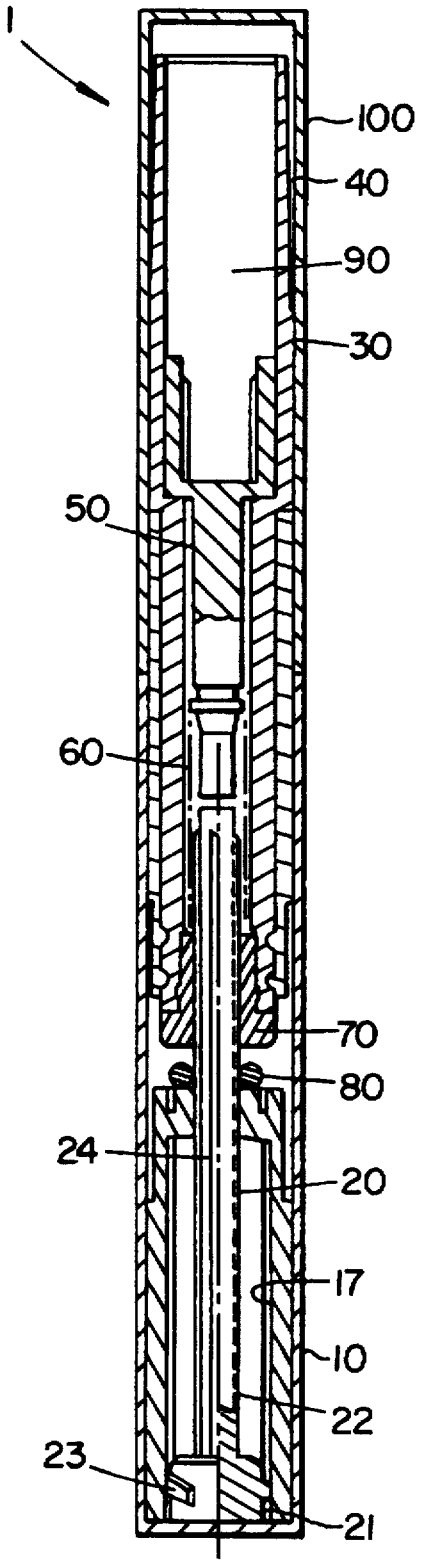
FIG. 16 is a longitudinal sectional view of the stick-shaped cosmetic extrusion case of the second embodiment.
Figure 18:
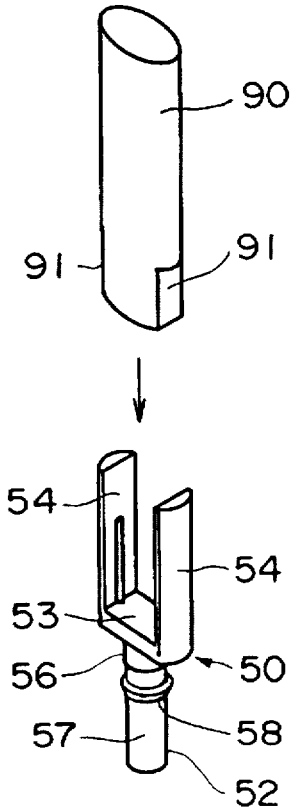
FIG. 18 is a perspective view of a holder and a stick-shaped cosmetic in the stick-shaped cosmetic cartridge according to the second embodiment of the present invention.
Figure 19:
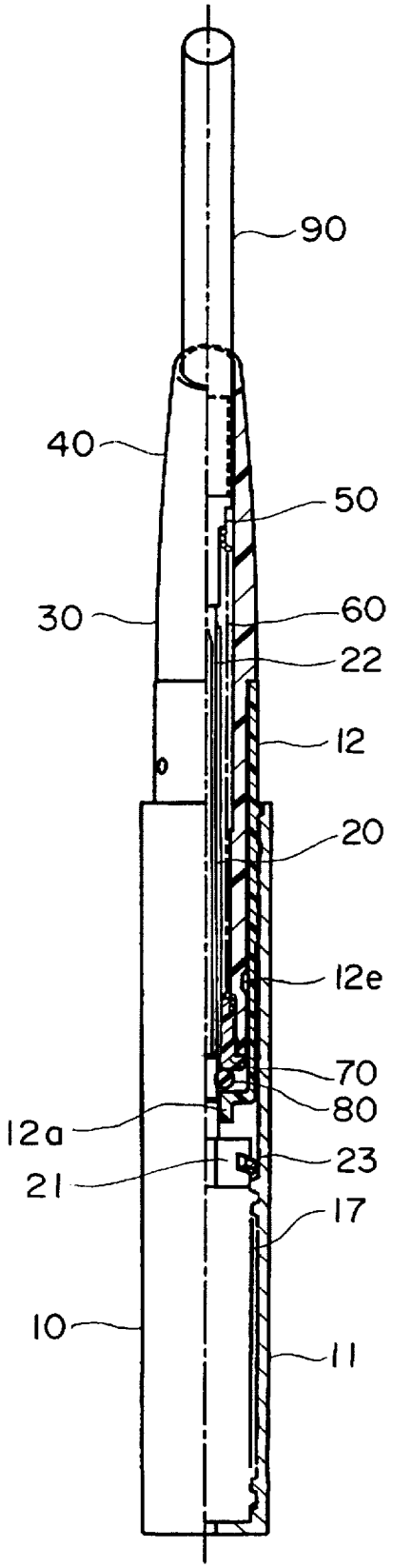
FIG. 19 is a front view showing a stick-shaped cosmetic extrusion case according to a third embodiment of the present invention in the extruded state, the right half being broken away in a section.
Figure 20:
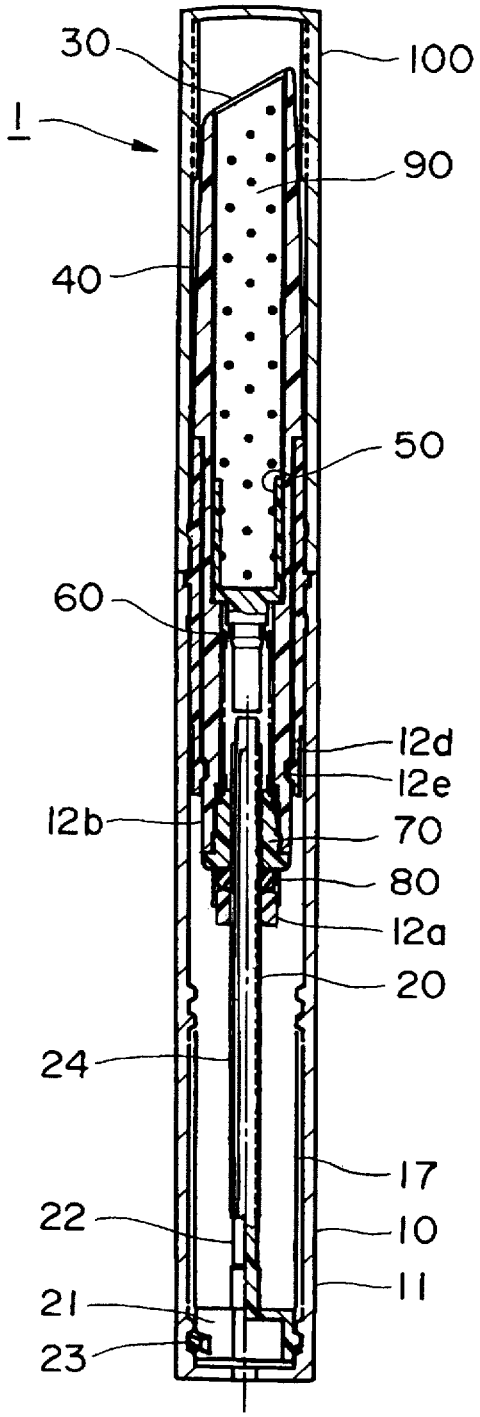
FIG. 20 is a longitudinal sectional view of the stick-shaped cosmetic extrusion case of the third embodiment.
Figure 21:
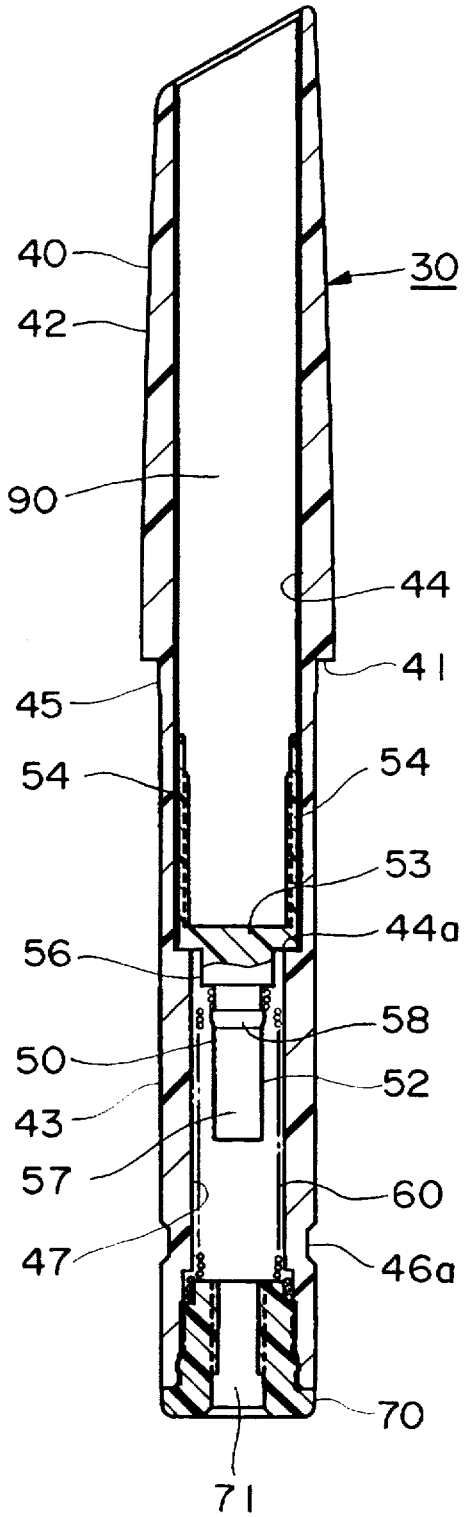
FIG. 21 is a longitudinal sectional view of a stick-shaped cosmetic cartridge according to the third embodiment of the present invention.
Figure 22:
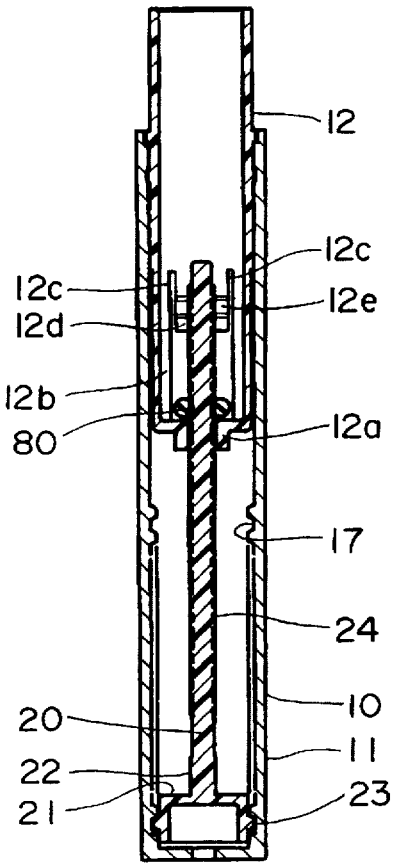
FIG. 22 is a longitudinal sectional view showing a case body and a extrusion rod of the stick-shaped cosmetic cartridge according to the third embodiment of the present invention.
Figure 23:
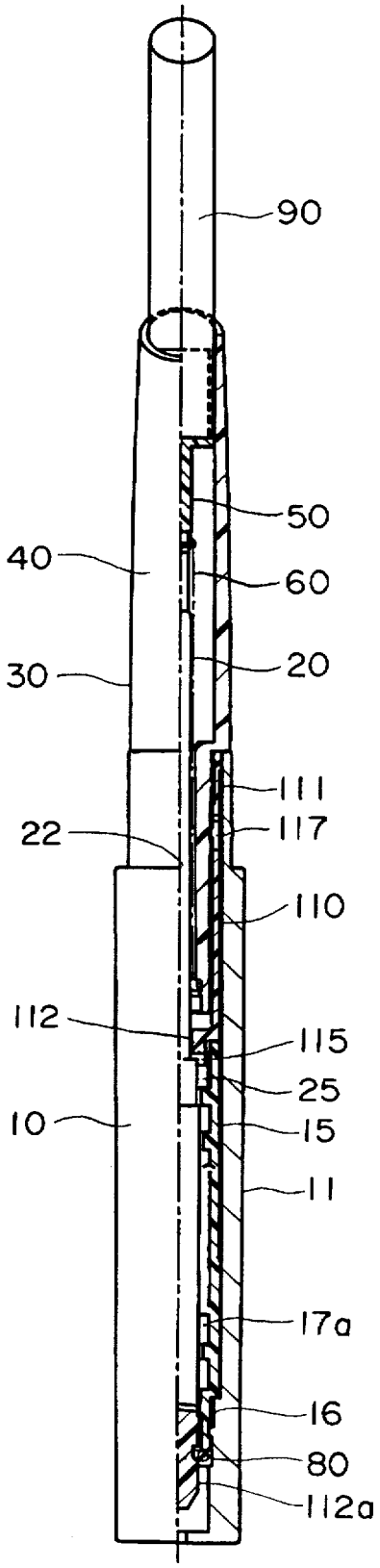
FIG. 23 is a front view showing a stick-shaped cosmetic extrusion case according to a fourth embodiment of the present invention in the extruded state, the right half being broken away in a section.
Figure 24:
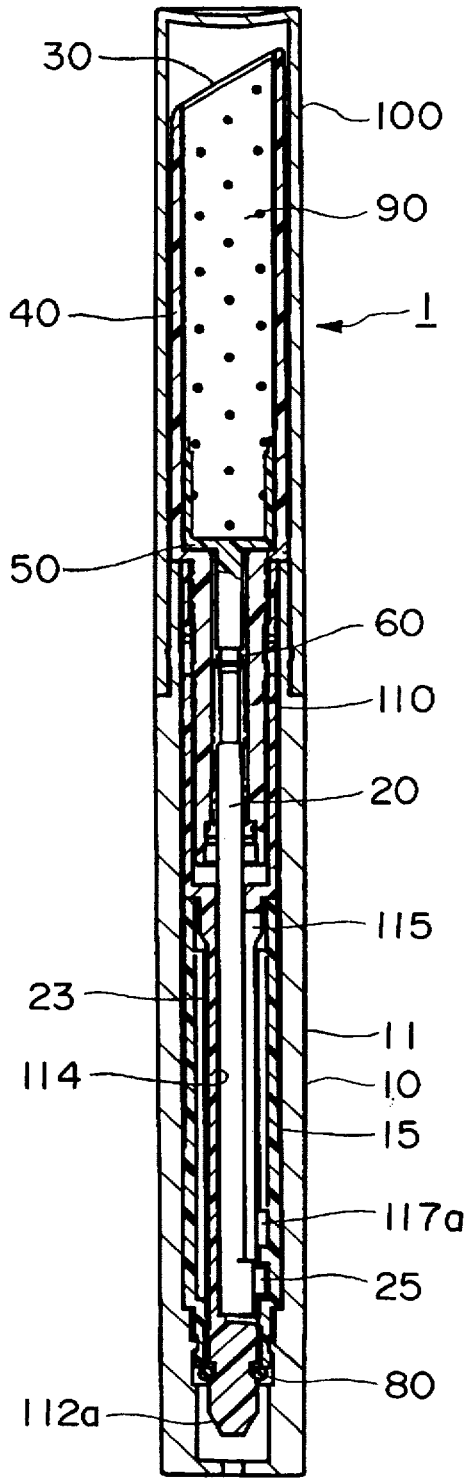
FIG. 24 is a longitudinal sectional view of the stick-shaped cosmetic extrusion case of the fourth embodiment.

In this state, the internal cylinder 15 and the bottom cap 70 are spaced each other so that a frictional ring 80 is disposed in the space therebetween. The frictional ring 80 is made of synthetic rubber in a ring-like shape having a section as shown in FIG. 14 and have a central hole through which the extrusion rod 20 is inserted.

The frictional ring 80 is held between the internal cylinder 15 and the bottom cap 70 in a state compressed in the axial direction so that the frictional ring 80 always biases the internal cylinder 15 and the bottom cap 70 by the elastic resiliency thereof.

In the case 1 in which the cartridge 30 as structured above is installed, the housing cylinder 40 of the cartridge 30 is permitted to rotate relative to the case body 10 and prevented from moving in the axial direction, and the extrusion rod 20 is prevented from rotating relative to the housing cylinder 40 and permitted to move in the axial direction. Therefore, as the case body 10 and the housing cylinder 40 are rotated relative to each other, the extrusion rod 20 rotates relative to the internal cylinder 15 of the case body 10 so that the extrusion rod 20 moves in the axial direction because of the propelling action by the combination of the internal threads 17 of the internal cylinder 15 and the external threads 23.

As the extrusion rod 20 is moved relative to the case body 10 by rotating the case body 10 relative to the housing cylinder 40 in the clockwise direction, the extrusion rod 20 comes into contact with the shaft portion 52 of the holder 50 so that the shaft portion 52 is pushed upward against the biasing force of the spring 60 and the stick-shaped cosmetic 90 thereby extrudes through the housing cylinder 40 (see FIG. 1). In this case, the holder 50 never rotates relative to the housing cylinder 40.

On the other hand, as the extrusion rod 20 is moved downward relative to the case body 10 by rotating the case body 10 relative to the housing cylinder 40 in the anti-clockwise direction, the holder 50 also moves downward following the extrusion rod 20 since the holder 50 is biased downward by the spring 60, thereby drawing the stick-shaped cosmetic 90 inside the housing cylinder 40.

During the relative rotation between the case body 10 and the housing cylinder 40, suitable frictional force is developed between the frictional ring 80 and the internal cylinder 15, the bottom cap 70, or the extrusion rod 20, thereby preventing the undesirable rotation of the case body 10 relative to the housing cylinder 40 and facilitating the control in the length of the extruded stick-shaped cosmetic 90 for use.

Furthermore, since the frictional ring 80 is always in contact with the internal cylinder 15 and the bottom cap 70, the frictional ring 80 functions to prevent the relative rotation between the internal cylinder 15 and the bottom cap 70 due to the frictional force between them, thereby preventing the rotation of the stick-shaped cosmetic 90 held by the holder 50 during the user is putting the cosmetic on her lip or the like.

In this embodiment, the internal threads 17 of the case body 10, the external threads 23 of the extrusion rod 20, the protrusions 24 of the extrusion rod 20, and the extrusions 72 of the bottom cap 70 of the cartridge 30 constitute together a transformation mechanism which transforms the relative rotation between the case body 10 and the housing cylinder 40 into the axial movement of the extrusion rod 20 relative to the housing cylinder 40.

[Second Embodiment]

Hereinafter, a second embodiment of a cartridge 30 and a case 1 with the cartridge 30 according to the present invention will be described with reference to FIG. 15 through FIG. 18. Since the basic construction of the case 1 of the second embodiment is the same as that of the first embodiment, the same components are marked with the same reference numerals as the first embodiment, respectively, so that the description will be omitted but the difference from the first embodiment described below.

In the second embodiment, the frictional ring 80 is formed in a ring-like shape having a circular section and is in contact with the internal cylinder 15 and the extrusion rod 20 but not in contact with the bottom cap 70.

[Third Embodiment]

Hereinafter, a third embodiment of a cartridge 30 and a case 1 with the cartridge 30 according to the present invention will be described with reference to FIG. 19 through FIG. 22. Since the basic constitution of the case 1 of the third embodiment is the same as that of the first embodiment, the same components are marked with the same reference numerals as the first embodiment, respectively, so that the description will be omitted but the differences from the first embodiment described below.

The case body 10 does not have the internal cylinder 15 and the external cylinder 11 is provided with an internal threads 17 formed on the lower inner surface thereof into which the external threads 23 of the extrusion rod 20 screw. The supporting cylinder 12 has a lower portion 12*a* of a smaller diameter and is provided with two windows 12*b* facing each other above the lower portion 12*a*. The supporting cylinder 12 is also provided with slits 12*c* silted from the both side edges of the windows 12*b* so as to form elastic strips 12*d* between the slits 12*c*. Each elastic strip 12*d* has a protrusion 12*e* formed on the inner surface thereof which engages a ring-like groove 46*a* of the housing cylinder 40 in the cartridge 30. Therefore, the cartridge 30 is installed in such a manner to be rotatable relative to the supporting cylinder 12 and prevented from moving in the axial direction.

The frictional ring 80 is formed in a ring-like shape having a circular section and is disposed between the lower portion 12*a* of the supporting cylinder 12 and the bottom cap 70 in the supporting cylinder 12. The tip end of the housing cylinder 40 of the cartridge 30 is cut obliquely.

[Fourth Embodiment]

Hereinafter, a fourth embodiment of a cartridge 30 and a case 1 with the cartridge 30 according to the present invention will be described with reference to FIG. 23 through FIG. 28. The same components of the fourth embodiment as that of the first embodiment are marked with the same reference numerals, respectively, so that the description will be omitted but the differences from the first embodiment described below.

The case body 10 of the fourth embodiment does not have the supporting cylinder 12 and has a rotating cylinder 110, instead of the supporting cylinder 12, disposed inside the external cylinder 11 in such a manner that the rotating cylinder 110 is rotatable relative to the external cylinder 11. The rotating cylinder 110 comprises a large-diameter portion 111 formed in a hollow cylinder with an open upper end, a small-diameter shaft portion 112 extending downward from the large-diameter portion 111, and a stepped portion 113 formed between the large-diameter portion 111 and the shaft portion 112.

In the internal cylinder 15 according to the fourth embodiment, the narrowed portion 16 is disposed in the lower portion of the internal cylinder 15 and is provided with a helical groove 17*a* instead of the internal threads 17. The shaft portion 112 of the rotating cylinder 110 rotatably penetrates the internal cylinder 15 with the lower end 112*a* thereof projecting from the narrowed portion 16 and with the stepped portion 113 thereof being in contact with the upper end of the internal cylinder 15. The frictional ring 80 having a circular section is engaged to the outer periphery of the lower end 112*a* so that the frictional ring 80 is stopped at the lower end of the internal cylinder 15, thereby preventing the rotating cylinder 110 from coming off the internal cylinder 15.

The shaft portion 112 of the rotating cylinder 110 is provided with a vertical hole 114 inside thereof extending from the end at the large-diameter portion 111 side closer to the lower end thereof in the axial direction, and a long narrow guide slot 115 formed in the outer surface thereof, communicating with the vertical hole 114 and extending in the axial direction.

The extrusion rod 20 is accommodated in the vertical hole 114 of the shaft portion 112, with the upper portion of the extrusion rod 20 projecting inside the large-diameter portion 111, in such a manner that the extrusion rod 20 is permitted to move in the axial direction. The extrusion rod 20 according to the fourth embodiment is provided with an engaging projection 25 formed on the lower end thereof and projecting radially outward which penetrates the guide slot 115 to engage the helical groove 17*a* of the internal cylinder 15.

Therefore, by relatively rotating the rotating cylinder 110 and the internal cylinder 15 (i.e. the rotating cylinder 110 and the external cylinder 11), the engaging projection 25 of the extrusion rod 20 slides along the helical groove 17*a*, with the result that the extrusion rod 20 moves within the rotating cylinder 110 in the axial direction.

The large-diameter portion 111 of the rotating cylinder 110 is provided with elastic strips 117 which are spaced apart from each other circumferentially at a degree of 180* and formed by slits 116 cut in U-like shape in the outer surface thereof. Each elastic strip 117 is provided with a projection 118 formed on the inner surface thereof, slightly projecting inwardly.

Figure 25:
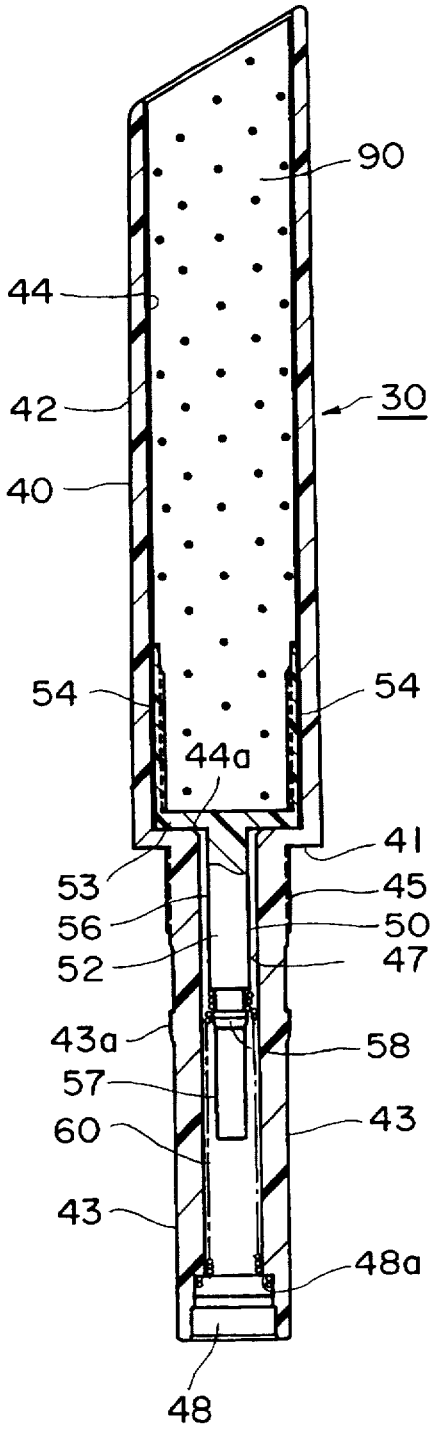
FIG. 25 is a longitudinal sectional view of a stick-shaped cosmetic cartridge according to the fourth embodiment of the present invention.
Figure 26:
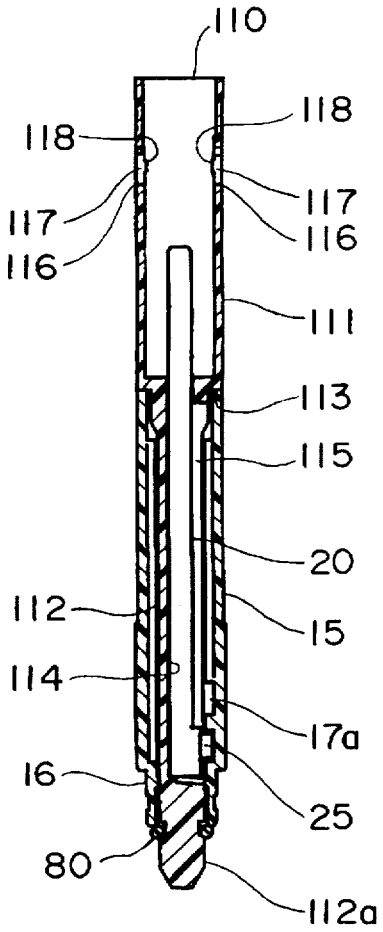
FIG. 26 is a longitudinal sectional view showing a part of a case body and an extrusion rod of the stick-shaped cosmetic cartridge according to the fourth embodiment of the present invention.
Figure 27:
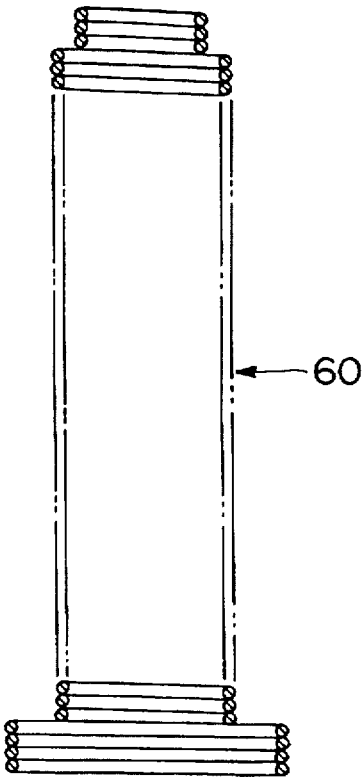
FIG. 27 is a longitudinal sectional view of a spring of the stick-shaped cosmetic cartridge according to the fourth embodiment of the present invention.
Figure 28:
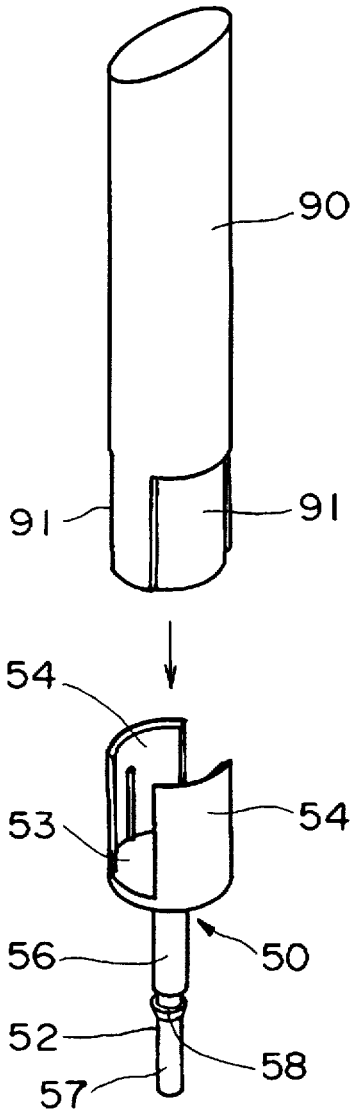
FIG. 28 is a perspective view showing a holder and a stick-shaped cosmetic in the stick-shaped cosmetic cartridge according to the fourth embodiment of the present invention.

The cartridge 30 according to the fourth embodiment has a stopping protrusion 43*a* formed in a ring-like shape on the outer surface of the circular portion 43 of the housing cylinder 40 as shown in FIG. 25. The cartridge 30 is not provided with the bottom cap 70. The tip end of the housing cylinder 40 is cut obliquely.

The cartridge 30 is installed in such a manner not to be rotatable relative to the rotating cylinder 110 and prevented from moving in the axial direction by engaging the circular portion 43 of the housing cylinder 40 into the rotating cylinder 110 of the case body 10 and engaging the stopping protrusion 43*a* with the projections 118.

In the case 1, by relatively rotating the housing cylinder 40 and the case body 10, the rotating cylinder 110 and the external cylinder 11 rotate relatively to each other, with the result that the extrusion rod 20 moves upward within the rotating cylinder 110 in the axial direction as described above and the stick-shaped cosmetic 90 held by the holder 50 thereby also moves upward.

According to the fourth embodiment, the helical groove 17*a* of the case body, the engaging projection 25 of the extrusion rod 20, and the guide slot 115 of the rotating cylinder 110 constitute together a transformation mechanism which transforms the relative rotation between the case body 10 and the housing cylinder 40 into the axial movement of the extrusion rod 20 relative to the housing cylinder 40.

What is claimed is:

1. A stick-shaped cosmetic cartridge comprising:

(a) a housing cylinder formed in a hollow cylindrical configuration with a through hole penetrating in the axial direction, said housing cylinder comprising a stepped portion formed on the way of said through hole, a large-diameter hole portion from said stepped portion to the distal end thereof, and a small-diameter hole portion from the stepped portion to the base end thereof;

(b) a holder having a holding portion for holding the base of a stick-shaped cosmetic and a shaft portion projecting outward from a bottom portion of the holding portion, wherein said holding portion is inserted into said large-diameter hole portion of said housing cylinder in such a manner that the holding portion is movable in the axial direction and engages the stepped portion of said housing cylinder so as to restrict its movable range, and said shaft portion is formed in such a manner as to enter in the small-diameter hole portion of said housing cylinder when the holding portion engages the stepped portion of said housing cylinder; and (c) a spring, one end of which engages said shaft portion of said holder and the other end of which engages said small-diameter hole portion of said housing cylinder so as to bias said holding portion of said holder in such a direction as to make said holding portion close to said stepped portion of the housing cylinder.

2. A stick-shaped cosmetic cartridge as claimed in claim 1, wherein said holding portion of said holder comprises a bottom plate and a pair of holding pieces standing on the bottom plate to face each other, and said holding pieces elastically holding the base of the stick-shaped cosmetic therebetween.

3. A stick-shaped cosmetic cartridge as claimed in claim 1, wherein said small-diameter hole portion of said housing cylinder is provided with a stepped portion to have a larger diameter at the base end side of the housing cylinder, and said shaft portion of said holder is provided with a stopping projection formed on an outer surface thereof, and wherein the one end of said spring engages said stopping projection of said holder and the other end of said spring engages said stepped portion of said small-diameter hole portion of said housing cylinder.

4. A stick-shaped cosmetic extrusion case comprising:

(a) a case body formed in a hollow cylindrical configuration with one open end;

(b) a housing cylinder formed in a hollow cylindrical configuration with a through hole penetrating in the axial direction, a base portion of said housing being inserted into said case body and a distal portion thereof projected outward through said open end of said case body in such a manner that said housing cylinder is permitted to rotate relative to said case body and not being permitted to move in the axial direction, said housing cylinder comprising a stepped portion formed on the way of said through hole, a large-diameter hole portion from said stepped portion to the distal end thereof, and a small-diameter hole portion from the stepped portion to the base end thereof;

(c) a holder having a holding portion for holding the base of a stick-shaped cosmetic and a shaft portion projecting outward from a bottom portion of the holding portion, wherein said holding portion is inserted into said large-diameter hole portion of said housing cylinder in such a manner that the holding portion is movable in the axial direction and engages the stepped portion of said housing cylinder so as to restrict its movable range, and said shaft portion is formed in such a manner as to enter in the small-diameter hole portion of said housing cylinder when the holding portion is in a position engaging the stepped portion of said housing cylinder;

(d) a spring, one end of which engages said shaft portion of said holder and the other end of which engages said small-diameter hole portion of said housing cylinder so as to bias said holding portion of said holder in such a direction as to make said holding portion close to said stepped portion of the housing cylinder;

(e) an extrusion rod accommodated in said case body, a distal portion of which is inserted into said small-diameter hole portion of said housing cylinder through an opening at the base side of said housing cylinder in such a manner that said extrusion rod is movable in the axial direction relative to the case body and the housing cylinder, wherein said extrusion rod extrudes the shaft portion of said holder against the biasing force of said spring when said extrusion rod moves toward the large-diameter hole portion of said housing cylinder; and (f) a transformation mechanism for transforming the relative rotation between said case body and said housing cylinder into the axial movement of said extrusion rod relative to the housing cylinder.

5. A stick-shaped cosmetic extrusion case as claimed in claim 4, wherein the cross section of said large-diameter hole portion of said housing cylinder, the cross section of said holding portion of said holder, and the cross section of the stick-shaped cosmetic are formed in non-circular configurations which are similar to each other.

6. A stick-shaped cosmetic extrusion case as claimed in claim 4, further comprising a short cylinder fixed to the base of said housing cylinder, an having a through hole through which said extrusion rod is inserted, wherein said transformation mechanism comprises a helical groove formed inside said case body, an engaging protrusion formed in said extrusion rod which engages said groove of said case body and slides along said groove, protrusions formed on an outer surface of said extrusion rod and elongated in the axial direction, and protrusions formed in an inner surface of said through hole of said short cylinder which engages said protrusion of said extrusion rod to prevent the relative rotation between said short cylinder and said extrusion rod and to permit the relative linear movement between said short cylinder and said extrusion rod.

7. A stick-shaped cosmetic extrusion case as claimed in claim 6, wherein said housing cylinder, said holder, said spring, and said short cylinder are previously assembled together in said housing cylinder to constitute a stick-shaped cosmetic cartridge, said stick-shaped cosmetic cartridge is attachable and removable to/from said case body in which said extrusion rod is previously installed.

8. A stick-shaped cosmetic extrusion case as claimed in claim 6, further comprising a frictional ring made of elastic material in a ring-like configuration which is disposed between said case body and said short cylinder and through which said extrusion rod is inserted.

9. A stick-shaped cosmetic extrusion case as claimed in claim 8, wherein said frictional ring is disposed between said case body and said short cylinder in the elastically compressed state.

10. A stick-shaped cosmetic extrusion case comprising:

(a) a case body formed in a hollow cylindrical configuration with one open end, (b) a rotating cylinder formed in a hollow cylindrical configuration with an open end, wherein said rotating cylinder is installed into said case body with the open end thereof being disposed in the same direction as said open end of said case body in such a manner that the rotating cylinder is permitted to rotate relative to said case body and not permitted to move in the axial direction;

(c) a housing cylinder formed in a hollow cylindrical configuration with a through hole penetrating in the axial direction, a base portion of said housing cylinder being inserted into said rotating cylinder and a distal portion thereof projecting outward through said open end of said rotating cylinder in such a manner that said housing cylinder is not permitted to rotate relative to said rotating cylinder and move in the axial direction, said housing cylinder comprising a stepped portion formed on the way of said through hole, a large-diameter hole portion from said stepped portion to the distal end thereof, and a small-diameter hole portion from the stepped portion to the base end thereof;

(d) a holder having a holding portion for holding the base of a stick-shaped cosmetic and a shaft portion projecting outward from a bottom portion of the holding portion, wherein said holding portion is inserted into said large-diameter hole portion of said housing cylinder in such a manner that the holding portion is movable in the axial direction and engages the stepped portion of said housing cylinder so as to restrict its movable range, and said shaft portion is formed in such a manner as to enter in the small-diameter hole portion of said housing cylinder when the holding portion is in a position engaging the stepped portion of said housing cylinder;

(e) a spring one end of which engages said shaft portion of said holder and the other end of which engages said small-diameter hole portion of said housing cylinder so as to bias said holding portion of said holder in such a direction as to make said holding portion close to said stepped portion of the housing cylinder;

(f) an extrusion rod accommodated in said rotating cylinder, a distal portion of which is inserted into said small-diameter hole portion of said housing cylinder through an opening at the base side of said housing cylinder in such a manner that said extrusion rod is movable in the axial direction relative to the rotating cylinder and the housing cylinder, wherein said extrusion rod extrudes the shaft portion of said holder against the biasing force of said spring when said extrusion rod moves toward the large-diameter hole portion of said housing cylinder; and (g) a transformation mechanism for transforming the relative rotation between said case body and said housing cylinder into the axial movement of said extrusion rod relative to the housing cylinder.

11. A stick-shaped cosmetic extrusion case as claimed in claim 10, wherein the cross section of said large-diameter hole portion of said housing cylinder, the cross section of said holding portion of said holder, and the cross section of the stick-shaped cosmetic are formed in non-circular configurations which are similar to each other.

12. A stick-shaped cosmetic extrusion case as claimed in claim 10, wherein said transformation mechanism comprises a helical groove formed inside said case body, a guide slot formed in said rotating cylinder and elongated in the axial direction, and an engaging protrusion radially protruding outward from an outer surface of said extrusion rod and penetrating through said guide slot of said rotating cylinder so that a distal end thereof engages said groove of said case body and slides along said groove.

13. A stick-shaped cosmetic extrusion case as claimed in claim 12, wherein said holder and said spring are previously assembled in said housing cylinder to constitute a stick-shaped cosmetic cartridge, said stick-shaped cosmetic cartridge is attachable and removable to/from said case body in which said rotating cylinder and said extrusion rod are previously installed.

14. A stick-shaped cosmetic extrusion case as claimed in claim 12, further comprising a frictional ring made of elastic material and disposed between said case body and said rotating cylinder.

* * * * *

UNITED STATES PATENT AND TRADEMARK OFFICE

CERTIFICATE OF CORRECTION

PATENT NO. : 5,765,955
DATED : June 16, 1998
INVENTOR(S) : Yoshikazu Tani

It is certified that error appears in the above-identified patent and that said Letters Patent is hereby corrected as shown below:

Column 5, line 2, delete "during" and insert --while-- therefor

Column 9, line 15, delete "than" and insert -above-- therefor

Column 9, line 16, delete "than" and insert --below-- therefor

Column 11, line 58, delete "during" and insert --while-- therefor

Column 12, line 24, delete "but" and insert --except for-- therefor

UNITED STATES PATENT AND TRADEMARK OFFICE

CERTIFICATE OF CORRECTION

PATENT NO. : 5,765,955
DATED : June 16, 1998
INVENTOR(S) : Yoshikazu Tani

It is certified that error appears in the above-identified patent and that said Letters Patent is hereby corrected as shown below:

Column 12, line 55, after "but" insert --for--

Column 14, line 57, before "projected" insert

--being--

Column 15, line 39, delete "an" and insert

--and-- therefor

Signed and Sealed this

Thirteenth Day of October 1998

*Attest:*

Bruce Lehman

BRUCE LEHMAN

*Attesting Officer*

*Commissioner of Patents and Trademarks*